US008469372B2

(12) United States Patent
Kloster et al.

(10) Patent No.: US 8,469,372 B2
(45) Date of Patent: Jun. 25, 2013

(54) SPLITBOARD BINDING APPARATUS

(76) Inventors: Bryce M. Kloster, Sandy, UT (US); Tyler G. Kloster, Snoqualmie, WA (US)

( * ) Notice: Subject to any disclaimer, the term of this patent is extended or adjusted under 35 U.S.C. 154(b) by 258 days.

(21) Appl. No.: 12/604,256

(22) Filed: Oct. 22, 2009

(65) Prior Publication Data

US 2010/0102522 A1 Apr. 29, 2010

Related U.S. Application Data

(60) Provisional application No. 61/108,021, filed on Oct. 23, 2008.

(51) Int. Cl.
*A63C 5/00* (2006.01)

(52) U.S. Cl.
USPC ..... 280/14.22; 280/14.24; 280/603; 280/611

(58) Field of Classification Search
USPC ..... 280/14.22, 14.24, 14.26, 601, 603, 280/611, 617, 623, 626, 818
See application file for complete search history.

(56) References Cited

U.S. PATENT DOCUMENTS

| | | | |
|---|---|---|---|
| 3,061,325 | A | 10/1962 | Glass |
| 3,171,667 | A | 3/1965 | Wightman |
| 3,439,928 | A | 4/1969 | Noguchi |
| 3,506,279 | A | 4/1970 | Lambert |
| 3,593,356 | A | 7/1971 | Schmalfeldt |
| 3,627,349 | A | 12/1971 | Barry |
| 3,782,745 | A | 1/1974 | Stoveken |
| 3,861,698 | A | 1/1975 | Greig |
| 4,022,491 | A | 5/1977 | Powell |
| 4,062,553 | A | 12/1977 | Riedel |
| 4,138,128 | A | 2/1979 | Criss |
| 4,163,565 | A | 8/1979 | Weber |
| 4,221,394 | A | 9/1980 | Campbell |
| 4,275,904 | A | 6/1981 | Pedersen |
| 4,403,785 | A | 9/1983 | Hottel |
| 4,652,007 | A | 3/1987 | Dennis |
| 4,700,967 | A | 10/1987 | Meatto et al. |
| 4,728,116 | A | 3/1988 | Hill |
| 4,741,550 | A | 5/1988 | Dennis |

(Continued)

FOREIGN PATENT DOCUMENTS

| | | |
|---|---|---|
| CH | 681 509 A5 * | 4/1993 |
| DE | 91 08 618.3 | 1/1992 |

(Continued)

OTHER PUBLICATIONS

Brochure for Nitro USA Snowboards, dated 1993-1994.

(Continued)

*Primary Examiner* — Katy M Ebner
*Assistant Examiner* — Emma K Frick
(74) *Attorney, Agent, or Firm* — Knobbe, Martens, Olson & Bear, LLP

(57) ABSTRACT

The present disclosure includes a binding apparatus for use on a splitboard. The binding apparatus may be used to change the splitboard between a snowboard for riding downhill in a ride mode and touring skis for climbing up a hill in a tour mode. The binding apparatus can include at least one board joining device. The binding apparatus can also include a binding interface configured to receive a boot and selectively attach to a ride mode interface in a snowboard configuration and to a tour mode interface in a ski configuration.

33 Claims, 11 Drawing Sheets

U.S. PATENT DOCUMENTS

| | | | | | |
|---|---|---|---|---|---|
| 4,817,988 | A | | 4/1989 | Chauvet et al. | |
| 4,856,808 | A | | 8/1989 | Longoni | |
| 4,871,337 | A | | 10/1989 | Harris | |
| 4,951,960 | A | | 8/1990 | Sadler | |
| 4,955,632 | A | | 9/1990 | Prestipino Giarritta et al. | |
| 4,973,073 | A | | 11/1990 | Raines et al. | |
| 5,028,068 | A | | 7/1991 | Donovan | |
| 5,035,443 | A | | 7/1991 | Kincheloe | |
| 5,044,654 | A | | 9/1991 | Meyer | |
| 5,054,807 | A | | 10/1991 | Fauvet | |
| 5,069,463 | A | | 12/1991 | Baud et al. | |
| 5,109,616 | A | | 5/1992 | Lush | |
| 5,145,202 | A | | 9/1992 | Miller | |
| 5,156,644 | A | | 10/1992 | Koehler et al. | |
| 5,249,816 | A | | 10/1993 | Southworth | |
| 5,299,823 | A | | 4/1994 | Glaser | |
| 5,344,179 | A | | 9/1994 | Fritschi et al. | |
| 5,397,150 | A | | 3/1995 | Commier et al. | |
| 5,542,197 | A | | 8/1996 | Vincent | |
| 5,551,728 | A | | 9/1996 | Barthel et al. | |
| 5,553,883 | A | | 9/1996 | Erb | |
| 5,558,354 | A | | 9/1996 | Lion | |
| 5,618,051 | A | | 4/1997 | Kobylenski et al. | |
| 5,649,722 | A | | 7/1997 | Champlin | |
| 5,660,416 | A | | 8/1997 | Schiele et al. | |
| 5,697,631 | A | * | 12/1997 | Ratzek et al. | 280/613 |
| 5,741,023 | A | | 4/1998 | Schiele et al. | |
| 5,762,358 | A | | 6/1998 | Hale | |
| 5,765,853 | A | | 6/1998 | Erb | |
| 5,816,590 | A | | 10/1998 | Fey et al. | |
| 5,820,139 | A | | 10/1998 | Grindl | |
| 5,884,933 | A | | 3/1999 | Trott | |
| 5,906,388 | A | | 5/1999 | Neiley | |
| 5,941,552 | A | | 8/1999 | Beran | |
| 5,966,844 | A | | 10/1999 | Hellerman et al. | |
| 5,984,324 | A | * | 11/1999 | Wariakois | 280/14.24 |
| 5,984,325 | A | | 11/1999 | Acuna | |
| 6,000,711 | A | * | 12/1999 | Fey et al. | 280/603 |
| 6,015,161 | A | | 1/2000 | Carlson | |
| 6,105,992 | A | | 8/2000 | Schaller et al. | |
| 6,206,402 | B1 | | 3/2001 | Tanaka | |
| 6,276,708 | B1 | | 8/2001 | Hogstedt | |
| 6,464,237 | B1 | * | 10/2002 | Gracie | 280/14.24 |
| 6,523,851 | B1 | * | 2/2003 | Maravetz | 280/603 |
| 6,616,151 | B1 | | 9/2003 | Golling | |
| 6,733,030 | B2 | * | 5/2004 | Okajima et al. | 280/613 |
| 7,073,813 | B2 | | 7/2006 | Martin et al. | |
| 7,097,194 | B2 | | 8/2006 | Kogler | |
| 7,267,357 | B2 | | 9/2007 | Miller et al. | |
| 7,320,474 | B2 | | 1/2008 | Quellais et al. | |
| 7,823,905 | B2 | * | 11/2010 | Ritter | 280/618 |
| 7,832,754 | B2 | | 11/2010 | Girard et al. | |
| 7,931,292 | B2 | | 4/2011 | Miralles | |
| 8,033,564 | B2 | | 10/2011 | Riepler et al. | |
| 2007/0216137 | A1 | | 9/2007 | Ritter | |
| 2008/0185814 | A1 | * | 8/2008 | Riepler et al. | 280/601 |

FOREIGN PATENT DOCUMENTS

| | | | | |
|---|---|---|---|---|
| DE | 29618514 | U1 | * | 1/1997 |
| DE | 89 03154.7 | | * | 3/1998 |
| EP | 0 362 782 | A2 | | 4/1990 |
| EP | 0 680 775 | B1 | | 11/1995 |
| EP | 0 362 782 | B2 | * | 10/1998 |
| WO | WO 98/17355 | | | 4/1998 |

OTHER PUBLICATIONS

Web page showing Salomon SNS Pilot Combi binding, www.salomon.com/us/products/sns-pilot-combi.html, dated Mar. 20, 2012.

* cited by examiner

SPLITBOARD BINDING APPARATUS

CROSS-REFERENCE TO RELATED APPLICATIONS

This application claims the benefit of, and priority to U.S. Provisional Patent Application Ser. No. 61/108,021, filed on Oct. 23, 2008 and entitled "Split Snowboard Binding System" which is incorporated in its entirety herein by reference.

BACKGROUND

1. The Field of the Invention

The present disclosure relates to split snowboards, also known as splitboards, and more specifically to a binding apparatus with a ride mode for joining two skis into a snowboard and a tour mode comprising a free heel binding attached to each ski.

2. The Relevant Technology

Splitboards are used for accessing backcountry terrain. Splitboards have a "ride mode" and a "tour mode." In ride mode, the splitboard is configured with at least two skis held together to form a board similar to a snowboard with bindings mounted somewhat perpendicular to the edges of the splitboard. In ride mode, the user can ride the splitboard like a snowboard down the mountain. In tour mode, the at least two skis of the splitboard are separated and configured with bindings mounted like a cross country free heel ski binding. In tour mode, the user attaches skins to create traction when climbing up a hill. When the user reaches the top of the hill or desired location the user can change the splitboard from tour mode to ride mode and snowboard down the hill. There are relatively few inventions that provide this basic splitboard functionality.

The Voile Split Decision system described in U.S. Pat. No. 5,984,324 to Wariakois was one of the first to give basic splitboard function. While functional, the system has its drawbacks. The binding assembly comprises an aluminum channel to span toe and heel slider blocks. The binding assembly is attached to a standard snowboard binding. The combination of the binding assembly and the standard snowboard binding creates a heavy system. Extra weight in backcountry touring equates to more energy expended by the user. In addition to the heavy weight, in order for the design of Wariakois to be strong enough for typical use the slider blocks and binding assembly channel are sized such that the standard snowboard binding sits five eighths of one inch to three quarters of one inch off of the snowboard. The extra height is referred to as "stack height." The extra stack height causes a user to over leverage the edge of the snowboard while turning making it difficult for the user to control the snowboard.

U.S. patent application Ser. No. 11/409,860 to Ritter improves upon the Wariakois system by integrating the binding assembly with a standard snowboard binding. The invention of Ritter shares many similar drawbacks with the Wariakois system. Both systems of Ritter and Wariakois take significant time to change from ride mode to tour mode and vice versa. The main reason being the user must remove the snowboard bindings from his or her feet before sliding the binding assembly off of the heel and toe slider blocks. Both systems also require the removal and insertion of pins. Long change over times may lead to the user becoming very cold in extreme winter conditions and may discourage use of the product.

In tour mode, both Ritter and Wariakois require a pin that slides through the toe portion of the binding assembly and the ski binding attached to the separate skis. In order for the pin to be easily removed and inserted, clearance must be added to the holes in the binding assembly and the ski binding. This clearance in the holes leads to slop in the tour mode causing the binding assembly to rattle on the ski binding. While touring in icy or crispy snow conditions, slop between the binding assembly and ski binding leads to difficulty in holding an edge while traversing. Instead of creating a high edge angle driving forces directly into the edge of the ski, the slop reduces the ski edge angle thus decreasing the leverage a user can apply to the edge of the ski for gripping into icy snow.

In ride mode, the interference slip fit of the slider blocks and binding assemblies of the Ritter and Wariakois systems are very susceptible to problems from manufacturing tolerances and wear. The design requires a very tight tolerance for the binding assembly channel to slide over the slider blocks. If the slider blocks fit too tight to the binding assembly channel, the user cannot slide the binding assembly channel over the slider blocks without modifying the slider blocks with a knife or file. If the slider blocks fit too loosely to the binding assembly channel, then the bindings can rattle while riding leading to an unresponsive and unsafe ride down the hill.

The conjoining apparatus for holding the skis together for the Warakois system is a set of interlocking hooks. This mechanism requires a net fit on the hooks for the skis to be held together tightly to form a snowboard. If manufacturing tolerances are slightly off on either the hooks or the skis or if the hooks wear down, the splitboard will be held loosely together causing the splitboard to rattle and come apart while riding.

Another device that provides the basic splitboard function is the Burton Splitboard system U.S. Pat. No. 6,523,851 to Maravetz. Maravetz tries to improve upon Wariakois by eliminating removable loose pins. Maravetz uses an intricate binding interface on the bottom of a snowboard binding to attach and join the splitboard. In normal winter snow conditions, snow can pack into the binding interface causing the attachment to function unreliably. In some cases the binding interface will not attach to the board interfaces and in others the attachment device can become frozen in place. Binding malfunctions such as these can strand a user in the backcountry for hours. Splitboard binding system must function properly in the harshest winter conditions.

The Poacher offered by Atomic Snowboarding also provides basic splitboard function. However, the Atomic Poacher requires a special lever tool to change from ride mode to tour mode and vice versa. Without the lever tool, the Atomic Poacher cannot be changed over. In addition, during change over, the Atomic Poacher turns into many small loose parts before they can be assembled into tour mode or ride mode. Loose parts such as the special lever tool and board clips can easily be lost in the deep backcountry snow leaving the user stranded.

In addition to the loose parts and change over troubles of the Atomic Poacher, its tour mode performs similarly to the Wariakois and Ritter devices. In order for the Atomic Poacher binding interface to attach to the ski bindings in tour mode easily, a substantial amount of clearance is left between the attachment pin and the tour mode interface, leading to the same decrease in the ski's ability to grip in icy snow conditions.

BRIEF SUMMARY

Embodiments of the present disclosure include a binding apparatus for use on a splitboard for converting the splitboard between a snowboard for riding downhill in ride mode and touring skis for climbing up hill in tour mode. In at least one embodiment, the splitboard binding apparatus can include at least one board joining mechanism including at least one buckle element to mount to a first ski and at least one hook element to mount to a second ski, the buckle element having a shear tab to engage the second ski and the hook element having a shear tab to engage the first ski to prevent shear movement of the first and second skis when joined with the board joining mechanism.

The binding apparatus can further include a binding interface configured to receive a snowboard boot and removably and interchangeably attach to a ride mode interface and a tour mode interface, a ride mode interface for removably attaching the binding interface to the splitboard in a ride mode such that the binding interface is positioned in a snowboard stance, and a tour mode interface for pivotably and removably attaching the binding interface to the separated touring skis of the splitboard in a tour mode such that the binding interface is positioned in a touring stance.

The tour mode interface of the binding apparatus can include a base portion configured to engage a toe pin of the binding interface, a slideable clip when in a first position engages the toe pin of the binding interface pivotally attaching the binding interface to the base portion of the tour mode interface and when in a second position disengages the toe pin of the binding interface allowing removal of the binding interface from the tour mode interface.

In one embodiment the ride mode interface can comprise of at least two latch mechanisms with a first latch mechanism rotatably attached to a first ski and a second latch mechanism rotatably attached to a second ski wherein the first latch mechanism rotatably engages the second latch mechanism and the second latch mechanism rotatably engages the first latch mechanism to create a ride mode interface to removably attach to the binding interface. In a further embodiment the ride mode interface can have at least one toe receiving mechanism mounted to a first or second ski and at least one heel receiving mechanism mounted to the other of the first and second skis wherein the toe receiving mechanism is configured to receive the toe attachment of the binding interface and the heel receiving mechanism is configured to receive the heel attachment of the binding interface. The binding interface can comprise a toe attachment mechanism and a heel attachment mechanism for attaching to the ride mode interface. In a further embodiment, at least one of the toe or heel attachment mechanisms can include a retractable pin.

These and other objects and features of the present disclosure will become more fully apparent from the following description and appended claims, or may be learned by the practice of the disclosure as set forth hereinafter.

BRIEF DESCRIPTION OF THE DRAWINGS

The foregoing aspects and many of the attendant advantages of this disclosure will become more readily appreciated as the same becomes better understood by reference to the following detailed description, when taken in conjunction with the accompanying drawings, which are schematic, and not to scale, wherein.

DETAILED DESCRIPTION

The present disclosure provides splitboard binding apparatuses configured for operation with a splitboard. The splitboard apparatus of the present disclosure may have various benefits over prior splitboard systems. For example, embodiments of the present disclosure may provide a splitboard system with a lighter weight and lower stack height than prior splitboard systems. In addition, embodiments of the present disclosure may provide a splitboard binding apparatus that can be easily operated without requiring removal of a user's feet/boots from the bindings. In further embodiments, the splitboard binding apparatus may provide a stiffer tour mode pivot and may ride more like a standard snowboard. In yet further embodiments, the splitboard binding apparatus of the present disclosure may be less susceptible to ice and snow buildup affecting its ease of use.

Several details of the example embodiment are set forth in the following description and corresponding figures. In the description that follows, it is understood that the figures related to the various example embodiments are not to be interpreted as conveying any specific or relative physical dimension, and that specific or relative dimensions related to the various embodiments, if stated, are not to be considered limiting unless future claims state otherwise.

Figure 1:
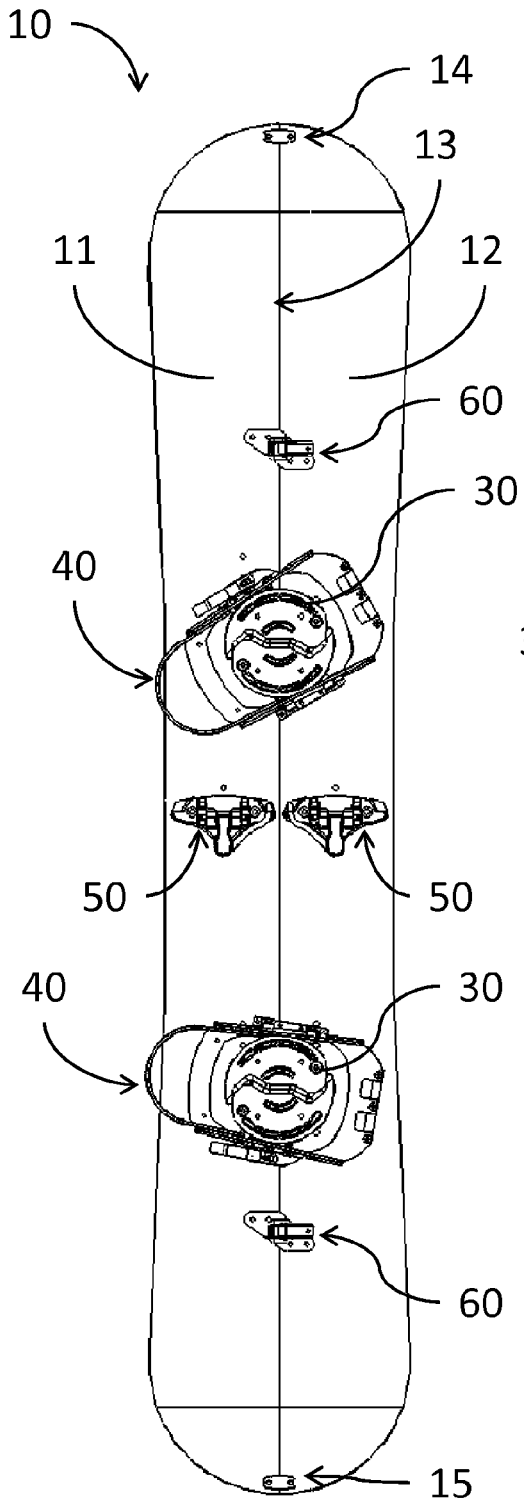
FIG. 1 is top view of an example splitboard in ride mode in accordance with at least one embodiment of the present disclosure.

Reference is now made to the Figures, which illustrate various example implementations of the present disclosure. FIG. 1 is a top view of an example Splitboard Binding Apparatus 10 mounted to a splitboard having a first ski 11 and a second ski 12 that when combined as shown can create a snowboard 13. In at least one implementation, the splitboard binding apparatus 10 can be configured to selectively join the first ski 11 and the second ski 12 of the splitboard, and/or allow the user to selectively ride the splitboard in either a ride mode or a tour mode.

According to one example embodiment, the Splitboard Binding Apparatus 10 may include one or more board joining devices 60 configured to join the first ski 11 to the second ski 12 to form the snowboard 13. The board joining devices 60 may be connected to the skis 11, 12 and positioned at any point along the length thereof. In one implementation, a first board joining device 60 can be positioned a distance away from the tips of the skis 11, 12 and a second board joining device 60 can be positioned a distance away from the tails of the skis 11, 12. In further implementations, the splitboard binding apparatus 10 may include any number of board joining devices 60 as desired, such as one board joining device 60 or three or more board joining devices 60 positioned at any point(s) along the length of the splitboard.

In further implementations, the splitboard binding apparatus 10 can include a nose clip 14 configured to couple the tips of the skis 11, 12 together. The nose clip 14 may be further configured to resist relative movement between the tips of the skis 11, 12 in at least one direction. In yet further embodiments, the splitboard binding apparatus can include a tail clip 15 configured to couple the tails of the skis 11, 12 together and resist relative movement between the tails of the skis in at least one direction. For example, FIG. 1 shows the splitboard in ride mode where board joining devices 60 join the first ski 11 and second ski 12 together to form the snowboard 13, and nose clip 14 and tail clip 15 prevent shear movement and/or scissoring of the tips and tails of skis 11, 12.

The splitboard binding apparatus 10 may also include one or more binding interfaces 40 configured to couple to a user's feet/boots and selectively attach to one or more additional interfaces of the splitboard binding apparatus 10 in a variety of configurations. In particular, as shown in FIG. 1, the binding interfaces 40 may be configured to selectively attach to one or more ride mode interfaces 30 in a snowboard stance, in order to allow the user to operate the splitboard in ride mode. In turn, the ride mode interfaces 30 may be connected to and/or assist in joining the first ski 11 and second ski 12.

Figure 2:
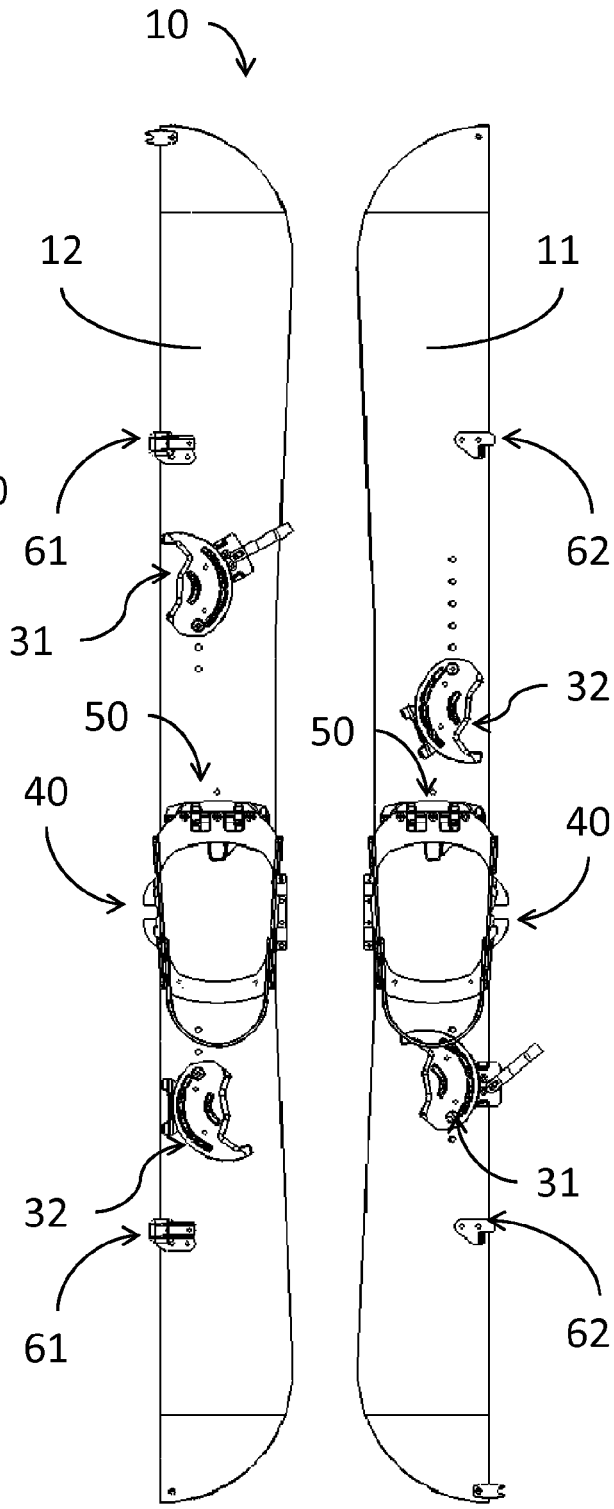
FIG. 2 is a top view of an example splitboard in tour mode in accordance with at least one embodiment of the present disclosure.

In further implementations, a user may separate the first ski 11 from the second ski 12 in order to ride the splitboard in tour mode. For example, FIG. 2 illustrates a top view of the splitboard of FIG. 1 in tour mode, wherein the board joining devices 60, nose clip 14, and tail clip are uncoupled and the first ski 11 and second ski 12 are separated. In particular, the board joining devices 60 may include a buckle element 61 and a hook element 62 that are selectively uncoupled to separate the first ski 11 from the second ski 12 to allow a user to operate the splitboard in tour mode. In addition, the ride mode interfaces 30 may separate and/or move to facilitate use of the splitboard in tour mode. For example, the ride mode interfaces 30 may include a first latch mechanism 31 and second latch mechanism 32 that are configured to separate and rotate in order to retract away for convenient use of the skis 11, 12 in tour mode.

In further implementations, the binding interfaces 40 can selectively couple to the separated skis 11, 12 in a touring stance. For example, the binding interfaces 40 may pivotally and removably attach to one or more tour mode interfaces 50 connected to the skis 11, 12. Accordingly, the tour mode interfaces 50 may allow the user to operate the skis 11, 12 in a tour mode, such as to ascend a slope.

Figure 3A:
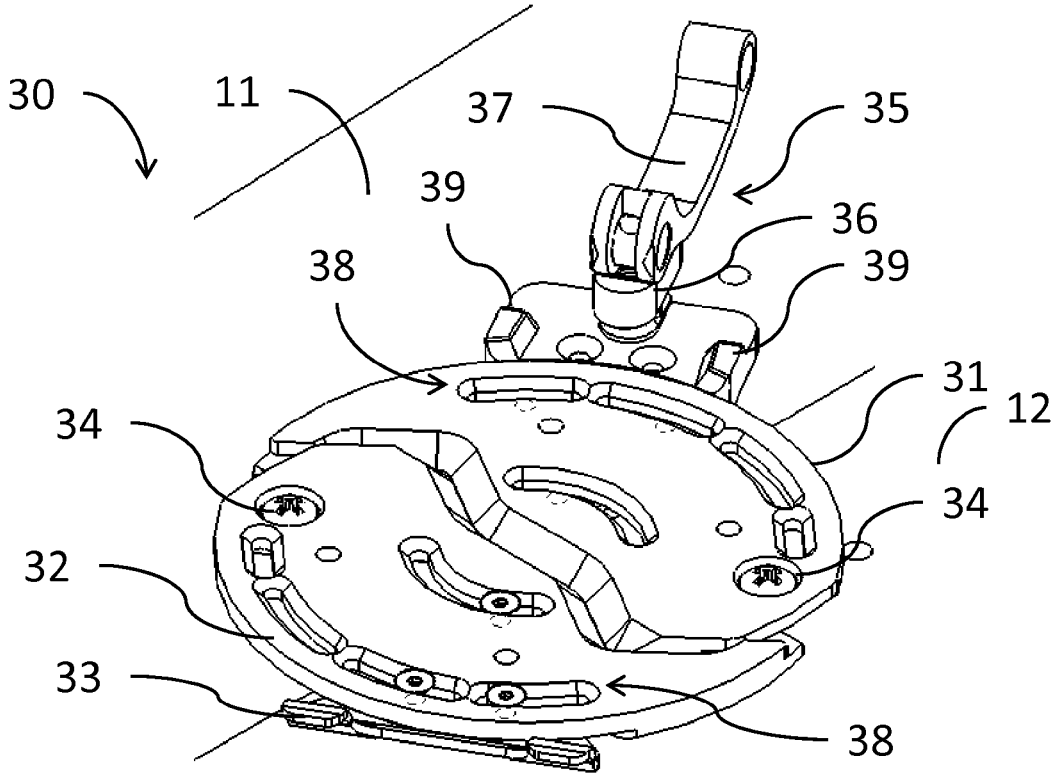
FIG. 3A is an isometric view of an example ride mode interface.
Figure 3B:
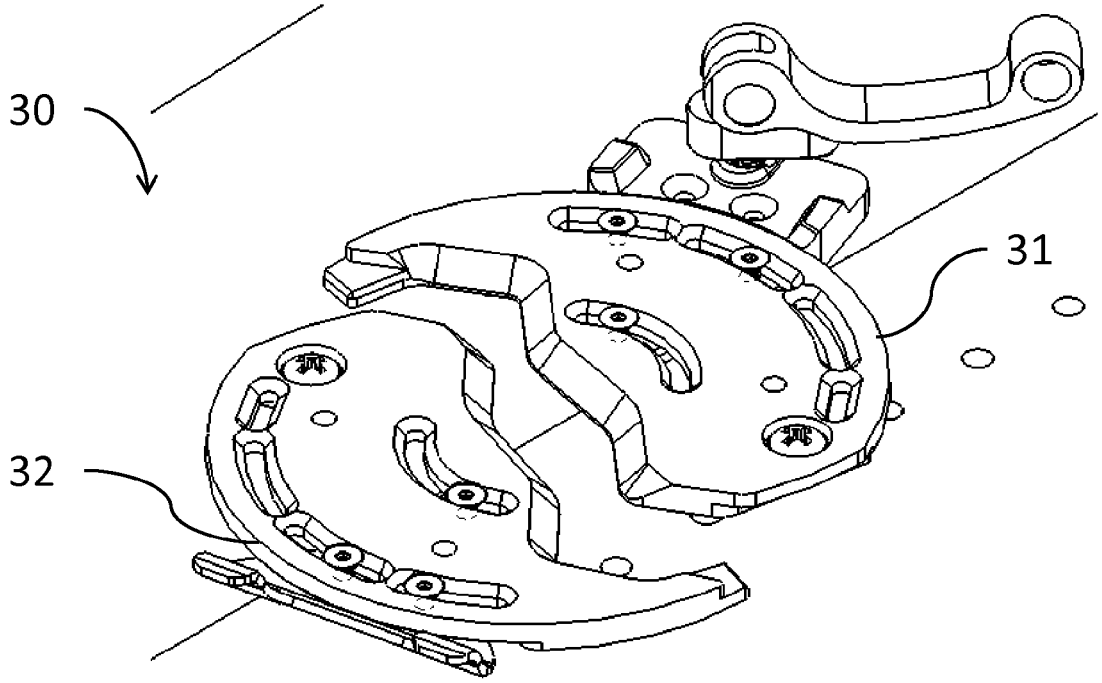
FIG. 3B is a further isometric view of the ride mode interface of FIG. 3A.

Reference is now made to FIGS. 3A-3B, which illustrate the ride mode interface 30 of FIGS. 1-2 in more detail. In particular, FIG. 3A illustrates a detailed isometric view of one of the ride mode interfaces 30 shown in ride mode (see FIG. 1 for ride mode). In one implementation, the ride mode interface 30 can include a first latch mechanism 31 rotatably attached to the first ski 11 with a screw 34 and second latch mechanism 32 rotatably attached to the second ski 12 with a screw 34. The first latch mechanism 31 and second latch mechanism 32 can be further configured to connect to a binding interface to allow a user to operate the splitboard in ride mode. In additional implementations, the first latch mechanism 32 and second latch mechanism 32 may also resist separation of and/or relative movement between the first ski 11 and second ski 12 when the splitboard is in ride mode.

In one implementation, the first latch mechanism 31 can include a locking mechanism 35 configured to assist in connecting and securing a binding interface to the ride mode interface 30. In one implementation, the locking mechanism 35 may be adjustably coupled to the first latch mechanism 31 through arced slots 38. The arced slots 38 may allow for angular adjustment of the ride mode interface 30. In particular, angular adjustment of the locking mechanism 35 may produce a corresponding angular adjustment of a binding interface with respect to the ride mode interface 30 and/or splitboard, thereby allowing a user to achieve a desired stance angle. In addition, the locking mechanism 35 can include a vertical stop 36, a cam lever 37, and/or positioning elements 39.

In additional implementations, the second latch mechanism 32 can include a binding interface attachment 33. The binding interface attachment 33 may be any member configured to stabilize, receive, abut, and/or connect to any portion of a binding interface to facilitate attachment of the binding interface 40 to the ride mode interface 30. In particular, the binding interface attachment 33 can include a base portion couple to the second latch mechanism 32 and one or more tabs extending away from the base portion and configured to receive, retain, stabilize, and/or connect to a portion of the binding interface 40. In some implementations, the binding interface attachment 33 may be coupled to the second latching mechanism 32 through arced slots allowing for angular adjustment of the ride mode interface 30. In particular, a user may angularly adjust the binding interface attachment 33 as desired and/or corresponding with angular adjustments of the locking mechanism 35 to produce the desired stance angle with respect to the splitboard.

In an additional implementation, each latch mechanism 31, 32 can have a substantially semi-circular shape with a rounded circular edge, adjacent to which the locking mechanism 35 and/or binding interface attachment 33 may be respectively positioned, and an opposing edge configured to abut the other latch mechanism 31, 32. In further implementations, the abutting edges of the latch mechanisms 31, 32 can be configured with corresponding features to improve the abutment of and resist relative movement between the latch mechanisms 31, 32. For example, the abutting edge of each latch mechanism 31, 32 can include a plurality straight portions angled with respect to each other and configured to couple with and abut corresponding portions of the abutting edge of the other latch mechanism. In additional implementations, each latch mechanism 31, 32 may include one or more tabs configured to insert into and be received by corresponding recesses within the other latch mechanism 31, 32 in order to resist relative upward and downward movement between the latch mechanisms 31, 32. In addition, the latch mechanisms 31, 32 may include other features configured to engage together. When the latch mechanisms 31, 32 engage together, as shown in FIG. 3A, they can create a substantially circular mounting interface for the binding interface 40 to mount to.

When a user desires to transition the splitboard to a tour mode, the user can disengage the latch mechanisms 31, 32 and rotate the latch mechanisms 31, 32 apart, as shown in FIG. 3B.

Figure 4A:
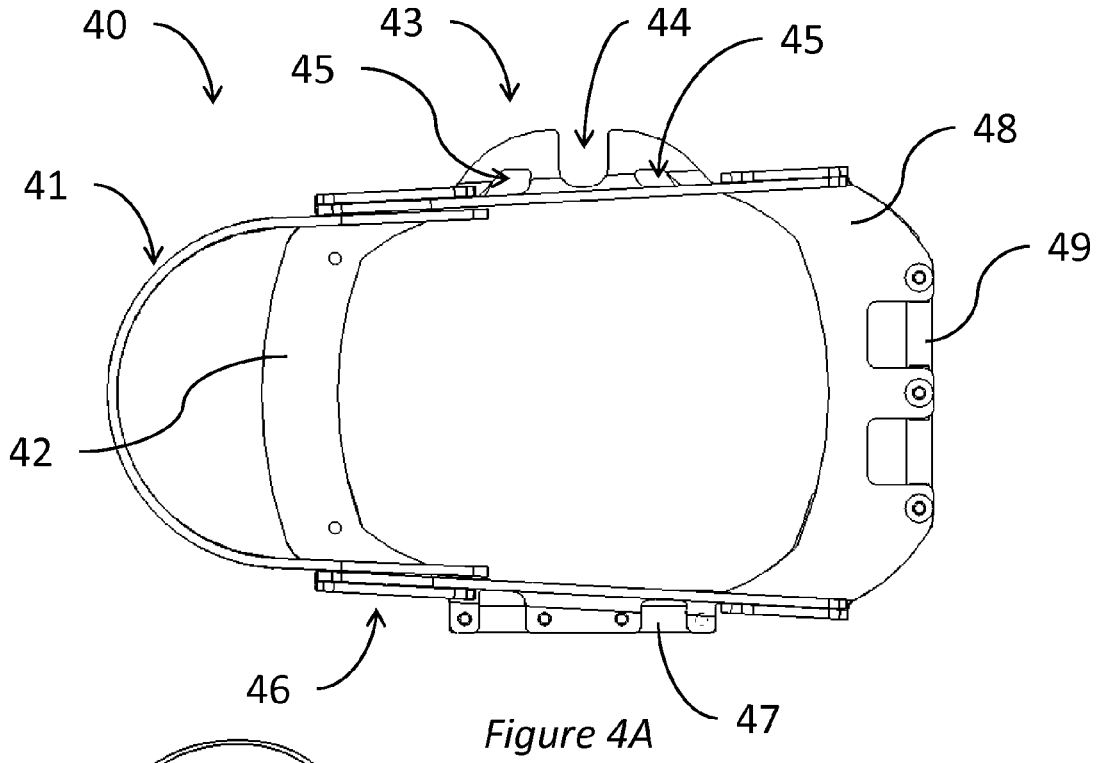
FIG. 4A is top view of an example binding interface.

Reference is now made to FIG. 4A, which illustrates a top view of the binding interface 40. The binding interface 40 can include a heel cup 41 and a heel side base portion 42 configured to receive and support the heel portion of a user's boot. In addition, the binding interface 40 can include a first side 46 and a second side 43. In one implementation, the second side 43 can include a second attachment locking portion 44. For example, the second attachment locking portion 44 may comprise a substantially flat flange extending away from the first side 43 of the binding interface 40 and including a slot configured to receive the locking mechanism 35 of the ride mode interface 30. The second attachment locking portion 44 may also include positioning cut outs 45 configured to receive corresponding positioning elements 39 of the locking mechanism 35 in order to achieve correct positioning of and resist relative movement between the binding interface 40 and the ride mode interface 30.

In further implementations, the first side 46 of the binding interface 40 may include a first attachment pin 47. In particular, the first attachment pin 47 may comprise a substantially cylindrical elongate member positioned along the length of and connected at a plurality of points to the binding interface 40. In addition, the first attachment pin 47 may be configured to be received, retained, and/or stabilized by the binding interface attachment 33 of the ride mode interface 30. In addition, the first attachment pin 47 may be configured to be at least partially rotatable relative to the binding interface attachment 33 and/or ride mode interface 30.

The binding interface 40 can also include a toe side base portion 48 configured to at least partially support the front of a user's boot. In addition the binding interface can include a toe pin 49 attached to the toe side base portion 48 and configured to selectively and rotatably couple to the tour mode interface 50 of the splitboard.

Accordingly, the binding interface 40 can be configured to receive a user's boot, such as a snowboard boot, and removably attach to the ride mode interface 30 and removably and pivotally attach to tour mode interface 50 as desired to allow a user to selectively operate the splitboard in either a ride mode or tour mode.

Figure 4B:
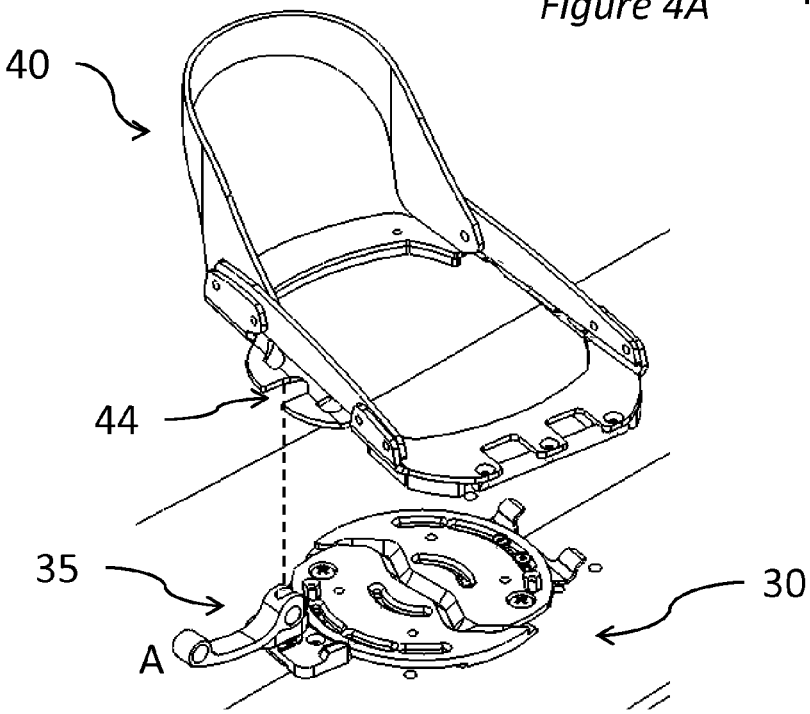
FIG. 4B is an exploded isometric view of the binding interface of FIG. 4A and the ride mode interface of FIGS. 3A-3B.

Reference is now made to FIG. 4B, which illustrates an isometric exploded view of the binding interface 40 and ride mode interface 30. As shown, a user can position the binding interface 40 over the ride mode interface 30 in preparation to couple the binding interface 40 to the ride mode interface. As showing, the user can move the binding interface locking mechanism 35 of the ride mode interface 30 to a first position configured to receive the second attachment 44 of the binding interface 40.

Figure 4C:
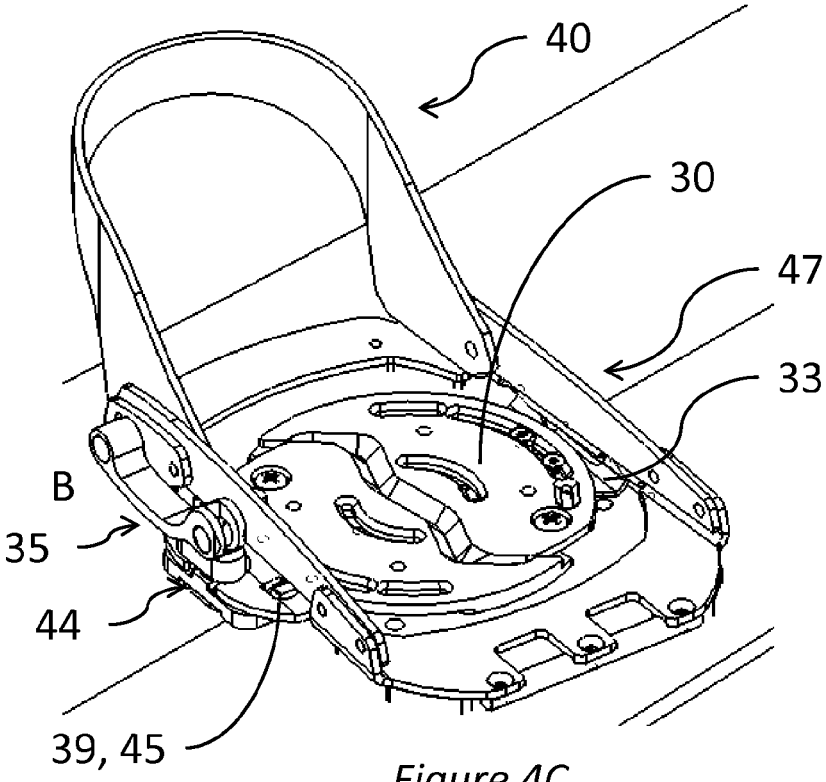
FIG. 4C is an isometric view of the binding interface of FIG. 4A attached to the ride mode interface of FIGS. 3A-3B.

Reference is now made to FIG. 4C, which illustrates an isometric view of binding interface 40 mounted to ride mode interface 30. In one implementation, a user may mount the binding interface 40 to the ride mode interface 30 by engaging the first attachment pin 47 of the binding interface 40 with the binding interface attachment 33 of the ride mode interface 30. In addition, the second attachment locking portion 44 of the binding interface 40 can engage and be received by the locking mechanism 35 of the ride mode interface 30. Thereafter, the user can move the locking mechanism 35 to a second position to at least partially secure the binding interface 40 to the ride mode interface 30. In particular, the user can rotate the cam lever 37 and vertical stop 36 of the locking mechanism 35 to abut an upper surface of the locking portion 44, thereby resisting release of the locking portion 44 and binding interface 40.

Figure 4D:
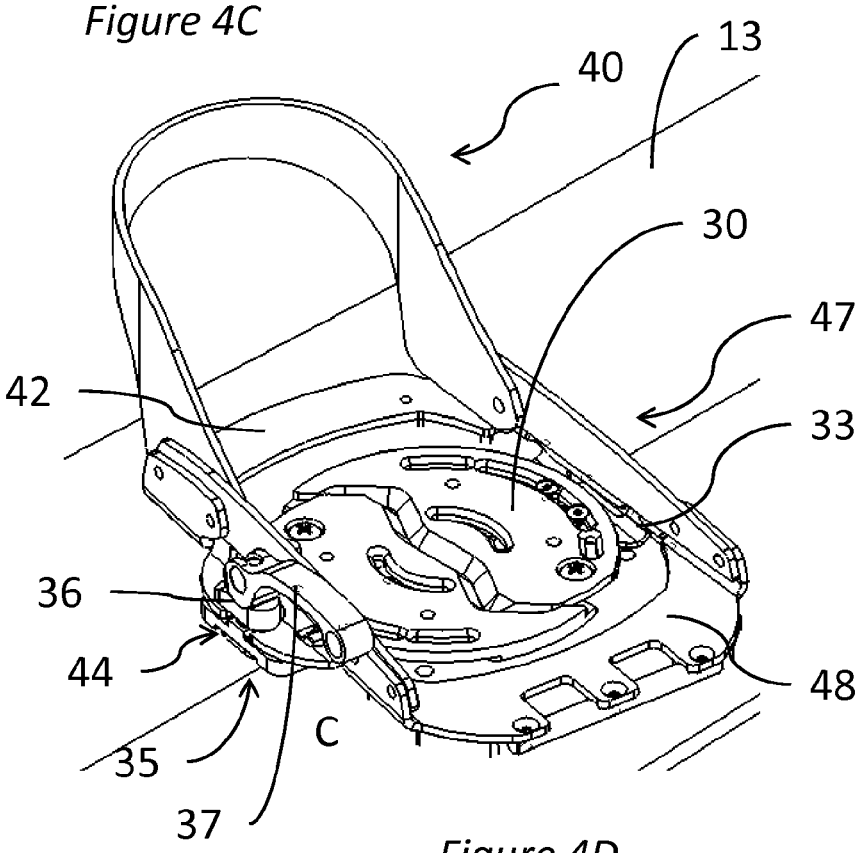
FIG. 4D is an isometric view of the binding interface of FIG. 4A attached to the ride mode interface of FIGS. 3A-3B, with the binding interface secured in place.

Reference is now made to FIG. 4D, which illustrates an isometric view of binding interface 40 mounted on and further secured to the ride mode interface 30. In particular, as shown in FIG. 4D, a user can move the locking mechanism 35 to a third position to further secure the second attachment locking portion 44 in place. For example, the user can close the cam lever 37 to push the vertical stop 36 downward and lock the vertical stop 36 and locking portion 44 in place. In one implementation, closing the cam lever 37 can apply pressure to the second attachment locking portion 44 with the vertical stop 36 in order to further secure the binding interface 40, thereby substantially reducing any "play" between the binding interface 40 and ride mode interface 30 and forcing heel side base portion 42 and toe side base portion 48 of binding interface 40 against the snowboard 13.

In like manner, a user may release the binding interface 40 by opening the cam lever 37 of the locking mechanism and moving the locking mechanism from the third position to the second position and then to the first position in order to disengage and release the second attachment locking portion 44 and binding interface 40. The user may then retract the binding interface 40 without having to remove the binding interface 40 from the user's boot.

Figure 5A:
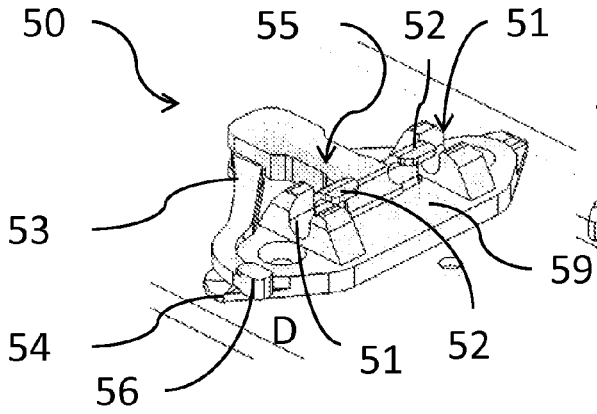
FIG. 5A is an isometric view of an example tour mode interface in a closed position.

Reference is now made to FIGS. 5A-5F, which illustrate various views of an example tour mode interface 50. FIG. 5A illustrates a transparent isometric view of the tour mode interface 50 with phantom lines illustrating various internal components of the tour mode interface 50. In one implementation, the tour mode interface 50 can include a base portion 59 with recesses 51 configured to receive a pin, such as the toe pin 49 of the binding interface. In addition, the binding interface 40 can include a slideable clip 58 (see also FIG. 5E) configured to releasably engage and/or secure a pin received within the recesses 51. In particular, the clip 58 can include retaining elements 52 configured to engage a pin and a spring tab 57 configured to transfer force and movement to the clip 58 from other components of the tour mode interface 50.

Figure 5B:
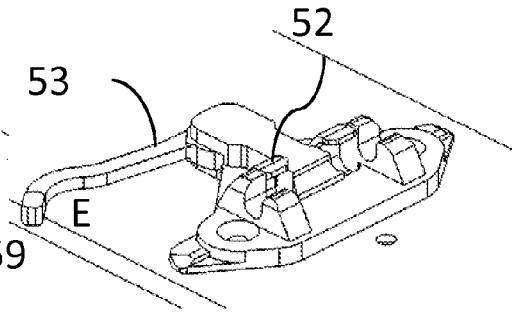
FIG. 5B is an isometric view of the tour mode interface of FIG. 5A in an open position.

In further implementations, the tour mode interface 50 can include a cam lever 53 configured to operate, such as open and close, the tour mode interface 50. For example, a user can operate the cam lever 53 to engage and disengage the clip 58 to engage and disengage a pin or pins received within the recesses 51. In one implementation, the user can move the cam lever 53 to a closed position, as shown in FIG. 5A, to move the clip 58 forward and capture a pin or pins within the recesses 51. The user can then move the cam lever 53 to an open position, as shown in FIG. 5B, to allow the clip 58 to move backward and release the pin(s).

In addition, the tour mode interface 50 can include a spring 55 configured to provide a backward force to the clip 58. As a result, the spring 55 may bias the clip 58 to an open, disengaging position, as showing in FIGS. 5B and 5D. In further implementations, the force of the spring 55 can be overcome by the cam lever 53 in order to move the clip into a closed, engaging position, as shown in FIGS. 5A and 5C.

In a yet further implementation, the tour mode interface 50 can include a locking feature 54 configured to resist the cam lever 53 from being inadvertently opened after being closed. In particular, the base portion can include a locking feature configured to engage the cam lever 53 when in a closed position. In addition, the cam lever 53 can include a boss feature 56 configured to engage with the locking feature 54 when in the closed position. In one implementation, in order to release the cam lever 53, the user may be required to lift up on the cam lever 53 to disengage the locking feature 54, thereby releasing the cam lever 53 to be opened.

As shown in FIG. 5A, the cam lever 53 is in closed position pushing the clip 58 forward to engage a pin positioned within the recesses 51. In addition, the clip 58 can allow the pin to rotate within the recesses 51 of the base portion 59 and relative to the tour mode interface 50. For example, and as shown in FIG. 5F, the binding interface 40 can be pivotally connected to the tour mode interface 50 with the toe pin 49 resting in the recesses 51 of base portion 59.

Figure 5C:
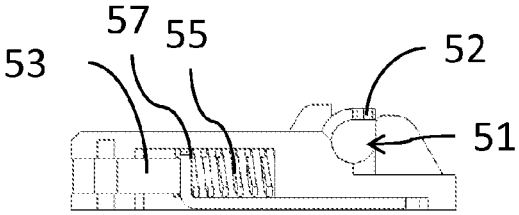
FIG. 5C is a side section view of the tour mode interface of FIG. 5A in a closed position.

FIG. 5C illustrates a cross-sectional side view of the tour mode interface 50 with the cam lever 53 in the closed position. As shown, in one implementation, the cam lever 53 pushes the clip 58 such that retaining elements 52 become positioned over the recesses 51 of the base portion 59 to engage a pin or pins within the recesses 51 and create a pivotal attachment between the tour mode interface 50 and binding interface 40.

Figure 5D:
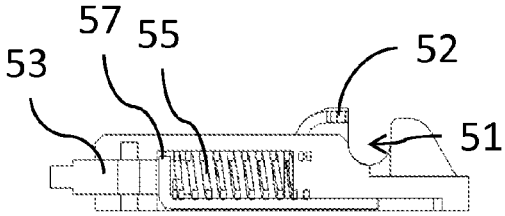
FIG. 5D is a side section view of the tour mode interface of FIG. 5A in an open position.

FIG. 5D illustrates a cross-sectional side view of the tour mode interface 50 with the cam lever 53 in an open position. As shown, in one implementation, the cam lever 53 disengages the clip 58 allowing spring 55 to extend pushing on the spring tab 57 of the clip 58 and moving the clip 58 backward and moving the retaining elements 52 away from the recesses 51 of base portion 59, thereby disengaging and/or releasing a pin or pins within the recesses 51. As a result, a user may, for example, release the toe pin 49 of the binding interface 40 and remove the binding interface 40 from the tour mode interface 50.

Figure 5E:
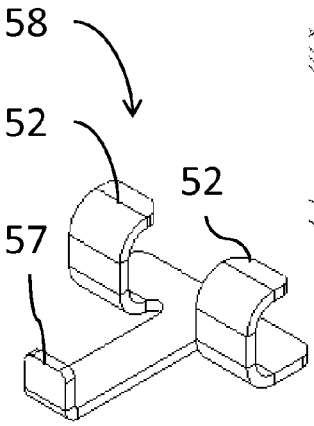
FIG. 5E is an isometric view of an example slideable clip of the tour mode interface of FIG. 5A.
Figure 5F:
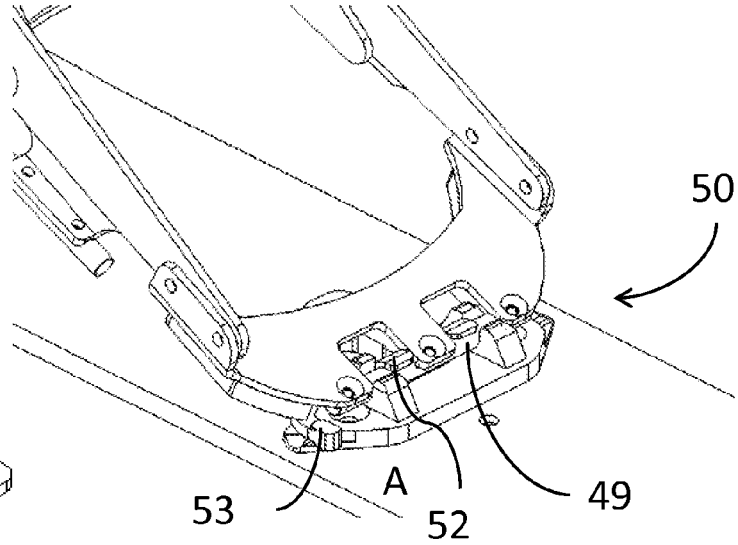
FIG. 5F is an isometric view of the binding interface of FIG. 4A removably and pivotably attached to the tour mode interface of FIG. 5A.

FIG. 5E illustrates an isometric view of the slideable clip 58 comprising the retaining features 52 and the spring tab 57.

Figure 6A:
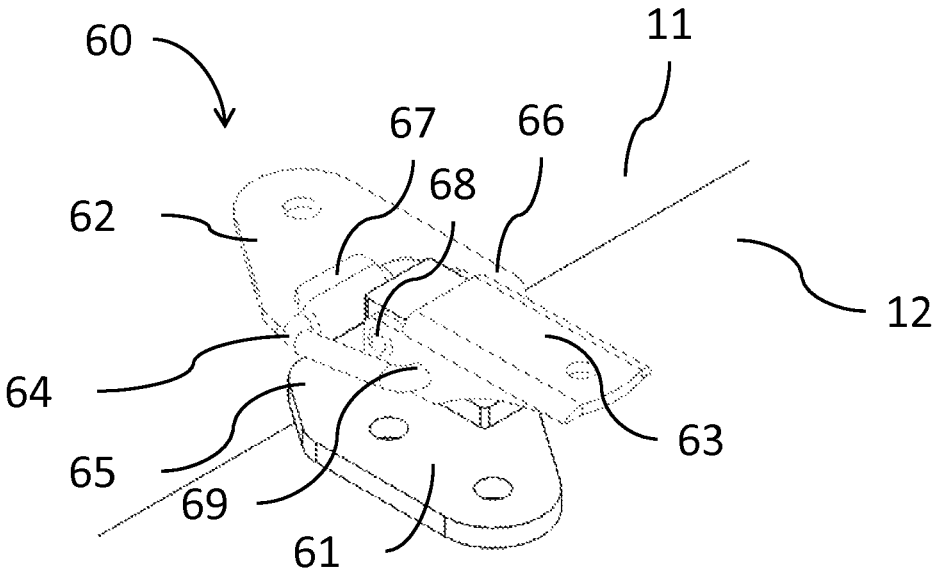
FIG. 6A is an isometric view of an example board joining mechanism in accordance with at least one embodiment of the present disclosure.
Figure 6B:
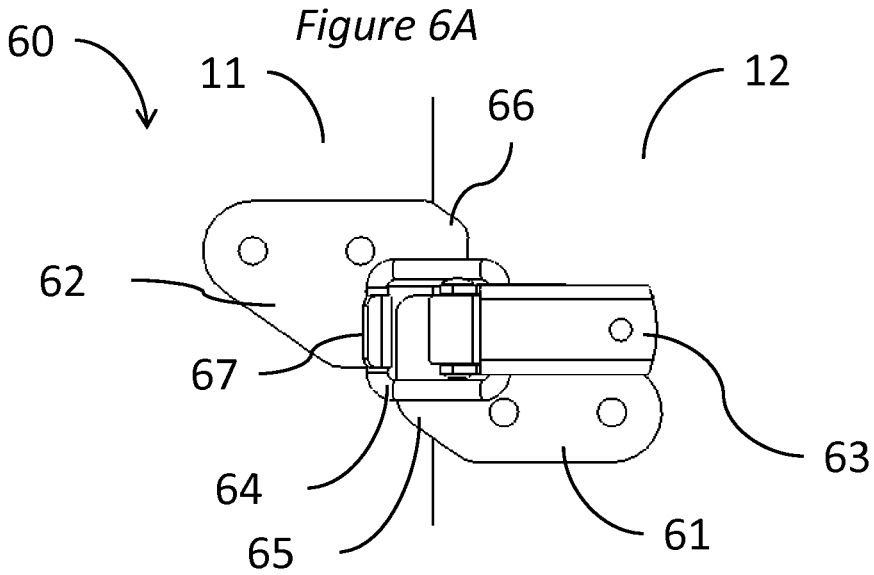
FIG. 6B is a top view of the board joining mechanism of FIG. 6A.
Figure 6C:
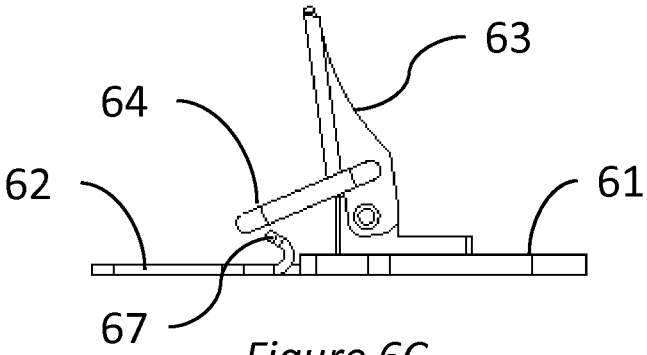
FIG. 6C is a side view of the board joining mechanism of FIG. 6A.

Reference is now made to FIGS. 6A-6C, which illustrate an example board joining device 60. In particular, FIG. 6A illustrates an isometric view of the board joining device 60. As shown, the board joining device 60 can include a buckle element 61. In one implementation, the buckle element 61 can include a cam 63, loop 64 coupled to the cam 63, and a base including a shear tab 65. In addition, the board joining device can include a hook element. In one implementation, the hook element 62 can include a hook 67 and base including a shear tab 66.

In one implementation, the hook element 62 can attach to the first ski 11 and the buckle element 61 can attach to the second ski 12. In a further implementation, a user can join the skis 11, 12 by engaging the hook element 62 with the buckle element 61. In particular, when the loop 64 of buckle element 61 engages the hook 67 of hook element 62 and the cam 63 is in the over-center position, defined by the pivot point 69 of loop 64 being below the pivot point 68 of cam 63, the first ski 11 and second ski 12 can be joined to create snowboard 13 (see e.g., FIG. 1).

FIG. 6B illustrates a top view of the board joining device 60. As shown in FIG. 6*b*, the shear tab 65 of buckle element 61 can engage the first ski 11 and overlap the seam between the first ski 11 and second ski 12. In addition, the shear tab 66 of the hook element 62 can engage second ski 12 and overlap the seam between the first ski 11 and second ski 12. As a result, the shear tabs 65, 66 may assist in preventing scissoring or shear movement of the skis 11 and 12.

FIG. 6C illustrates a side view of the board joining device 60 with the cam 63 lifted to release the loop 64 from the hook 67, thereby allowing the first ski 11 and second ski 12 to be separated (see e.g., FIG. 2).

Figure 7:
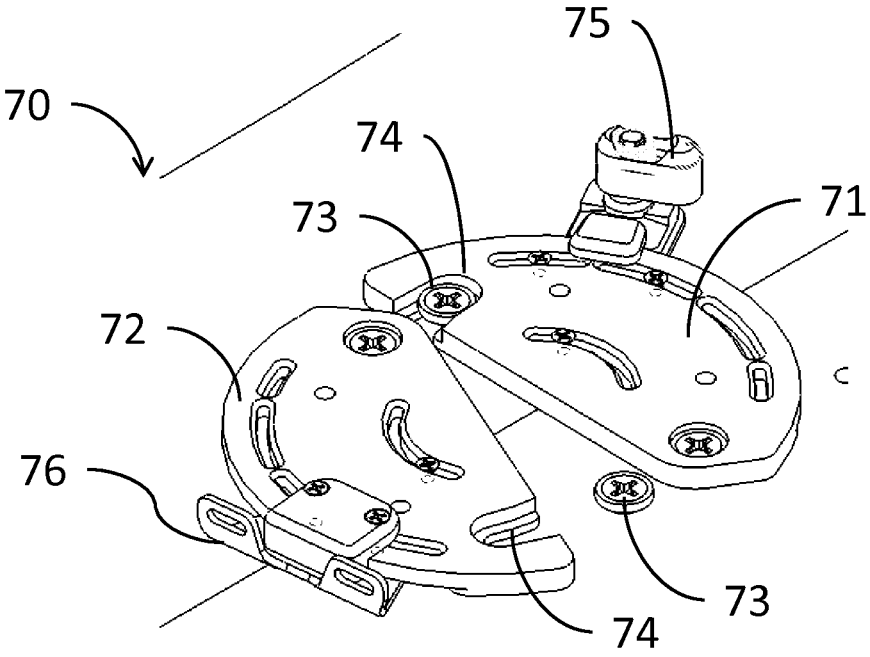
FIG. 7 is an isometric view of an additional example ride mode interface.

Reference is now made to FIG. 7, which illustrates an additional example ride mode interface 70 in accordance with the present disclosure. The ride mode interface 70 may be similar in many respects to the ride mode interface 30 illustrated in FIGS. 1-4 and described in more detail above, wherein certain features described above will not be repeated with respect to this embodiment. Like components may be given like reference numerals.

As shown, the ride mode interface 70 may include a first latch member 71 and a second latch member 72 rotatably attached to the first ski 11 and second ski 12, respectively, and configured to be positioned together and attached to a binding interface to allow a user to operate the splitboard in ride mode. In one implementation, the ride mode interface 70 may include one or more pins 73 attached to the skis 11, 12. In addition, the latch members 71, 72 may include one or more slots 74 configured to receive the pins 73 when the latch members 71, 72 are rotated to a ride mode position. When received within the slots 74, the pins 73 may at least partially secure the latch members 71, 72 in place. In particular, the pins may be configured to resist excessive rotation and relative movement between the latch members 71, 72 and between the latch member 71, 72 and splitboard.

The ride mode interface 70 may also include a locking mechanism 75 coupled to the first latch member and configured to secure a binding interface to the ride mode interface 70. In particular, a user may open and close the locking mechanism 75 by merely rotating the locking mechanism, thereby allowing the user to open the locking mechanism 75 to receive a binding interface and then close the locking mechanism 75 to secure the binding interface in place.

In a further implementation, the ride mode interface may include an attachment member 76 coupled to the second latch member and configured to engage, received, and/or stabilize a portion of the binding interface to mount the binding interface to the ride mode interface 70. In one embodiment, the attachment member 76 can include any number of slots, recesses, or tabs configured to receive, engage, and/or secure any portion of the binding interface.

Figure 8:
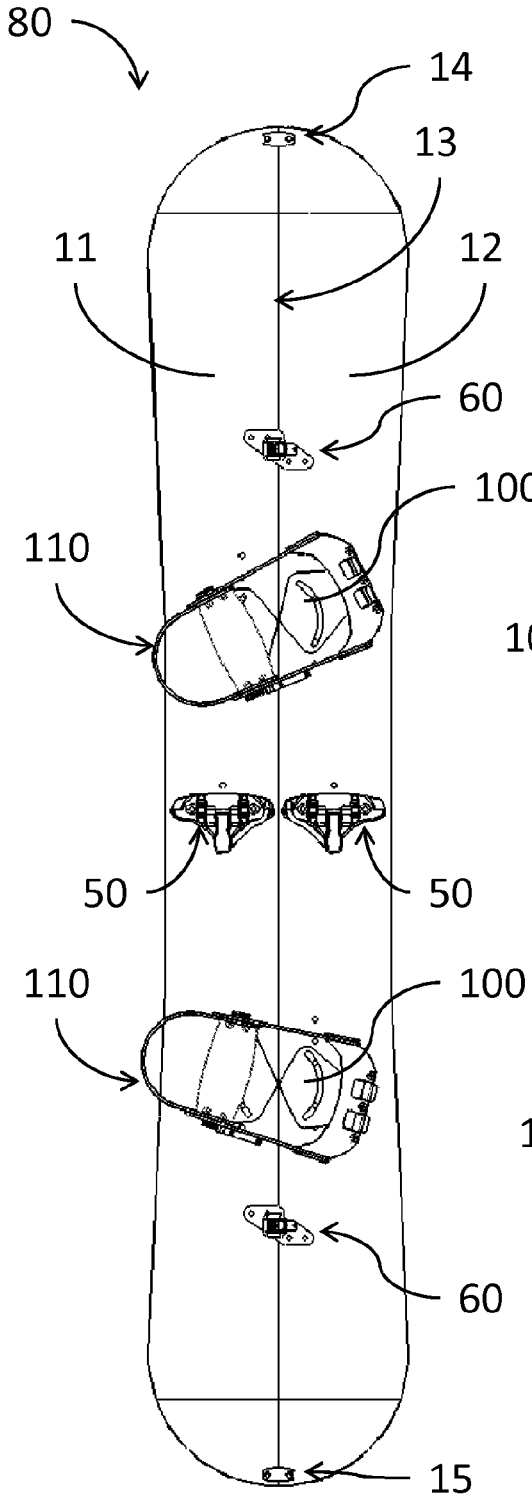
FIG. 8 is a top view of an additional example splitboard and splitboard binding apparatus in ride mode.

Reference is now made to FIG. 8, which illustrates a top view of a further example splitboard binding apparatus 80 in accordance with the present disclosure. The splitboard binding apparatus 80 of this embodiment may be similar to the splitboard binding apparatus 10 illustrated in FIGS. 1-6 and described in more detail above, wherein certain features described above may not be repeated with respect to this embodiment. Like features may be given like reference numerals.

In one implementation, the splitboard binding apparatus 80 may used in conjunction with a splitboard. In particular, the splitboard binding apparatus 80 may allow a user to selectively operate the splitboard in either a ride mode or tour mode. The splitboard binding apparatus 80 can include a ride mode interface 100, a tour mode interface 50, a binding interface 110, a board joining device 60, a nose clip 14 and a tail clip 15. FIG. 8 further shows the splitboard binding apparatus 80 in ride mode where the board joining devices 60 join the first ski 11 and second ski 12 into a snowboard 13, the binding interface 110 is mounted to the ride mode interface 100 in a snowboard stance, and the tip clip 14 and tail clip 15 at least partially resist shear movement or scissoring of the tips and tails of skis 11 and 12.

Figure 9:
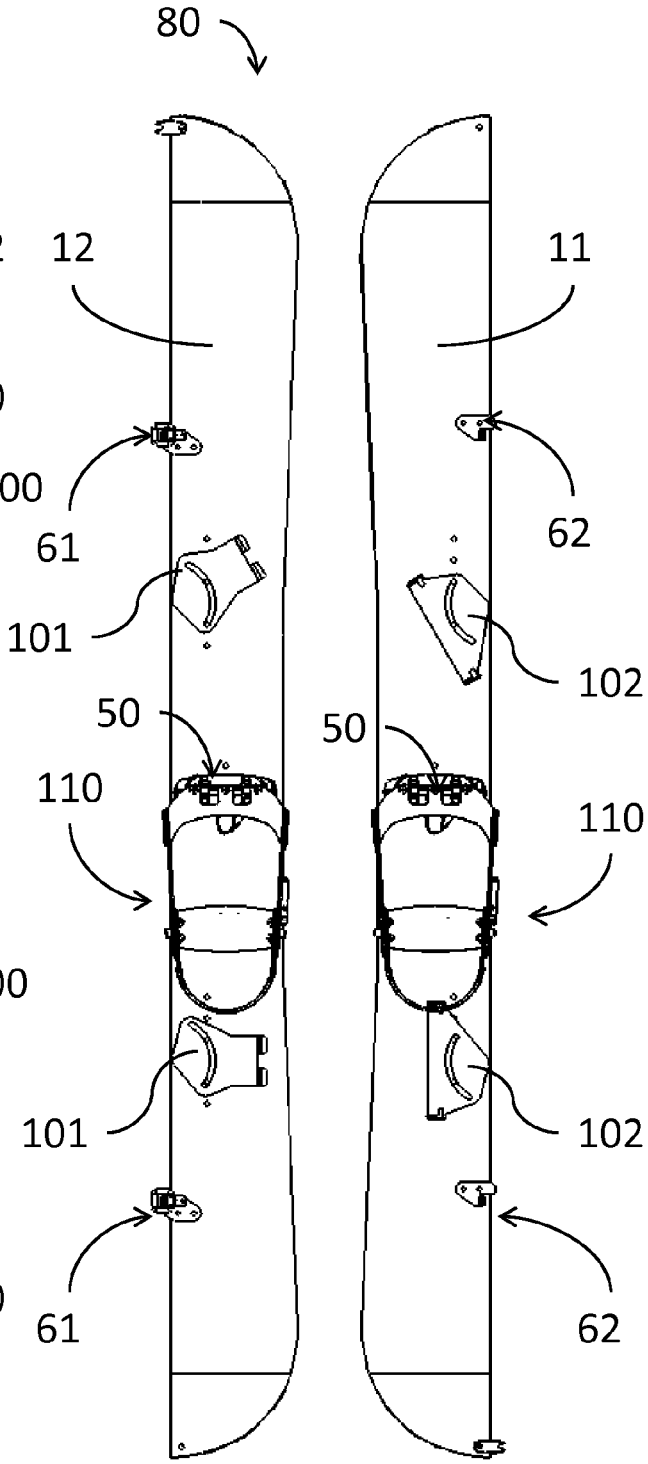
FIG. 9 is a top view of the splitboard and splitboard binding apparatus of FIG. 8 in tour mode.

FIG. 9 illustrates a top view of the splitboard binding apparatus 80 shown in tour mode, where the first ski 11 and second ski 12 are separated for ascending a snow covered slope, and the binding interface 110 is pivotally and removably attached to the tour mode interface 50. In addition, the buckle element 61 and hook element 62 of board joining device 60 are separated.

Figure 10:
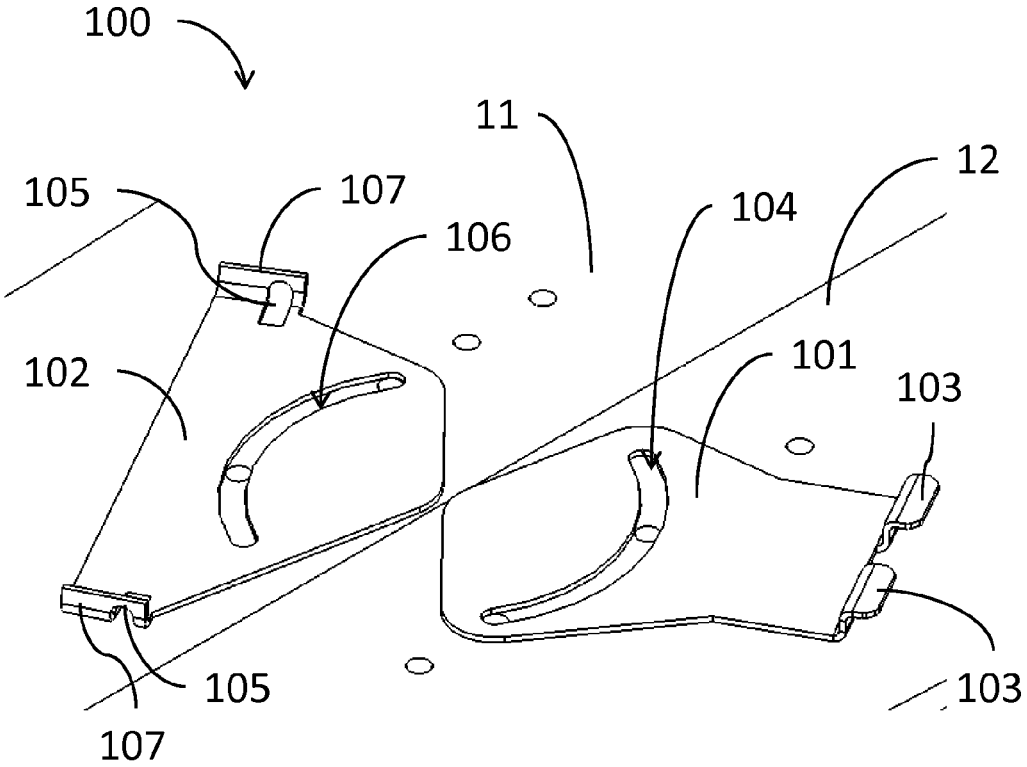
FIG. 10 is an isometric view of an example ride mode interface of the splitboard binding apparatus of FIGS. 8-9.

FIG. 10 illustrates an isometric view of the ride mode interface 100. In one implementation, the ride mode interface 100 can include at least one toe receiving mechanism 101 mounted to either the first ski 11 or second ski 12 and at least one heel receiving mechanism 102 mounted to the other of the first ski 11 or second ski 12. The toe receiving mechanism 101 can be configured to receive, engage, and/or secure a toe pin (e.g., first attachment toe pin 117) and can include a toe pin attachment 103 comprising one or more tabs configured to receive the first attachment toe pin 117 of binding interface 110. The toe receiving mechanism 101 can also include an arced slot 104 for mounting to either the first ski 11 or second ski 12. In a further implementation, the arced slot 104 can allow for angular adjustment of the ride mode interface 100 with respect to the splitboard. The heel receiving mechanism 102 can be configured to include flanges 107 with pin attachments 105, such as slots configured to receive a pin, spaced apart to receive the heel side portion 115 of the binding interface 110. The heel receiving mechanism 102 may also include an arced slot 106 for mounting to either the first ski 11 or second ski 12. In addition, the arced slot 106 can allow for angular adjustment of the ride mode interface 100 with respect to the splitboard.

Figure 11B:
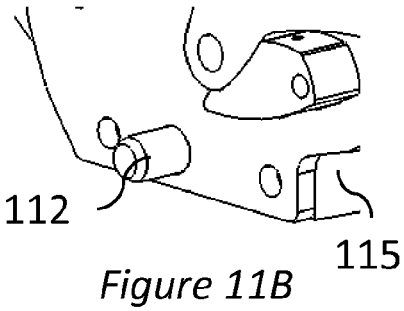
FIG. 11B is a detailed view of an example retractable pin of the binding interface of FIG. 11A in the extended position.
Figure 11C:
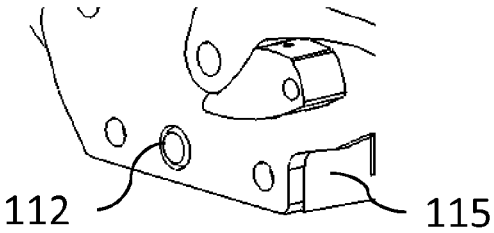
FIG. 11C is a detailed view of the retractable pin of FIG. 11B in the retracted position.
Figure 11A:
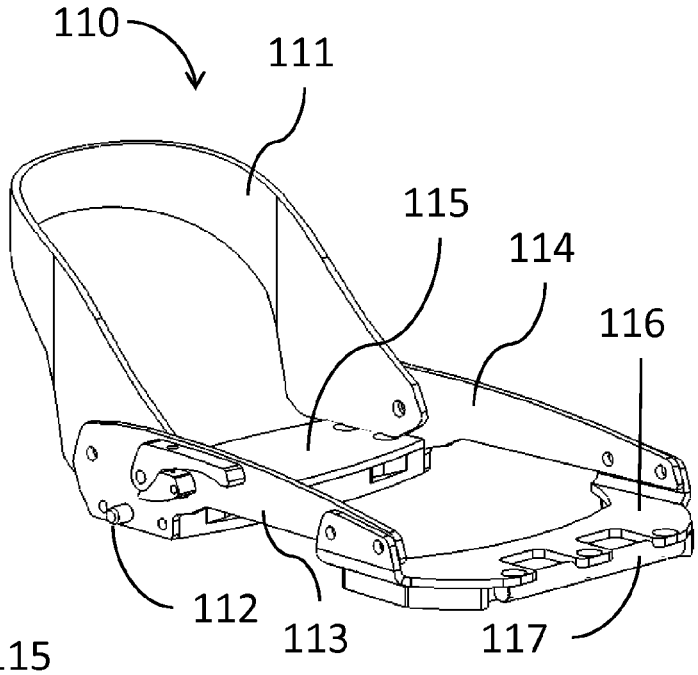
FIG. 11A is an isometric view of an example binding interface of the splitboard binding apparatus of FIGS. 8-9.

FIG. 11A illustrates an isometric view of the binding interface 110. In one implementation, the binding interface 110 can be configured to receive a user's boot, such as a snowboard boot, and to selectively and removably attach to the ride mode interface 100 and tour mode interface 50. In one implementation, the binding interface 110 can include a heel cup 111, a first side 113, a second side 114, a toe side base portion 116 with a first attachment 117, and a heel side base portion 115 with a second attachment 112. In one implementation the first attachment 117 can be a toe pin (e.g. toe pin 49) and the second attachment 112 can be a retractable pin. In addition, the second attachment retractable pin 112 can be configured to slide in and out of heel side based portion 115 to allow for attachment to the pin attachment 105 of the heel receiving mechanism 102. In particular, FIG. 11B illustrates a detailed view showing the second attachment retractable pin 112 extending out of the heel side base portion 115 of the binding interface 110. FIG. 11C illustrates a detailed view showing the second attachment retractable pin 112 retracted into the heel side base portion 115 of the binding interface 110.

Figure 12A:
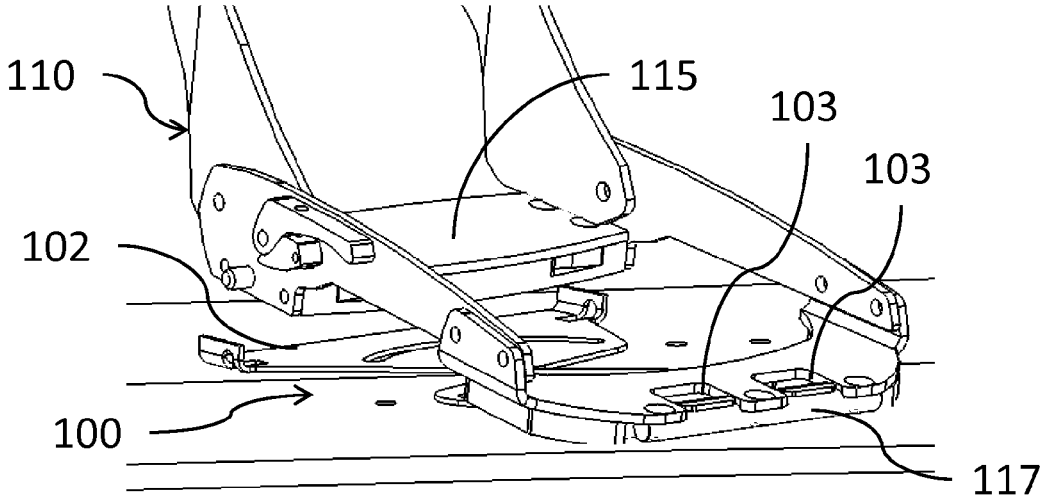
FIGS. 12A-12C are perspective views of the binding interface of FIG. 11A mounting to the ride mode interface of FIG. 10.
Figure 12B:
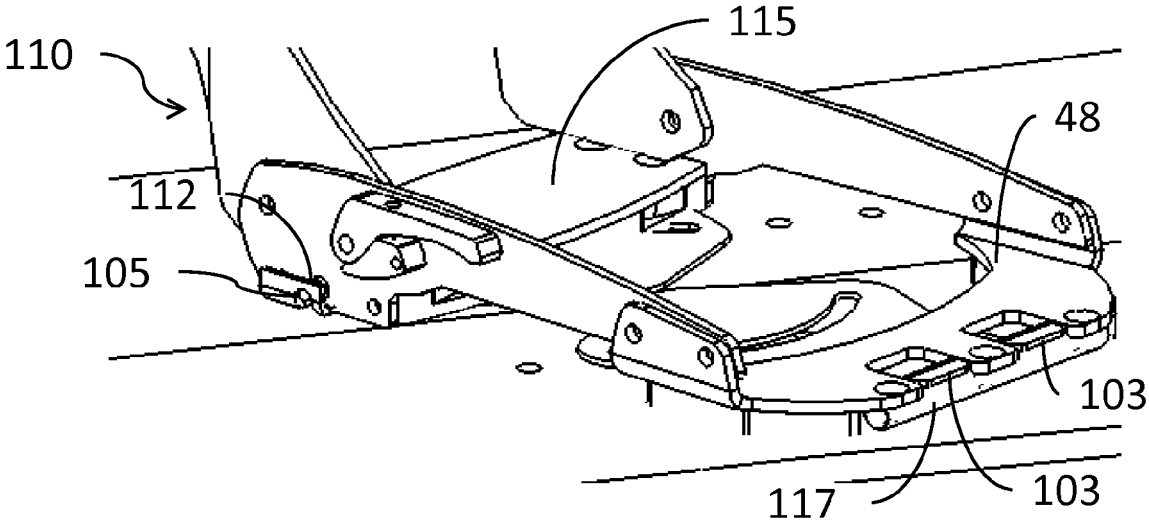
Figure 12C:
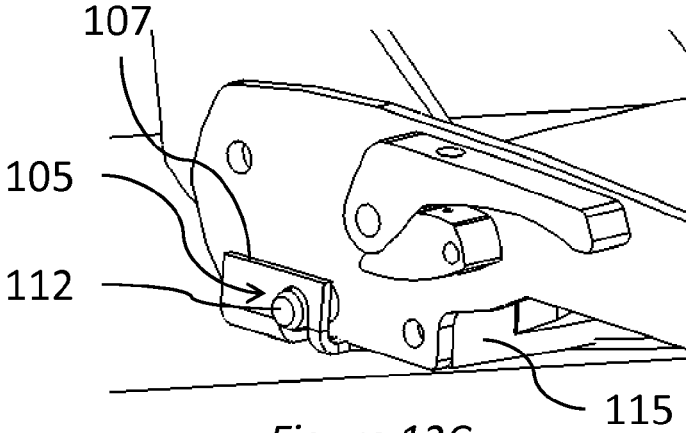

Reference is now made to FIGS. 12A-12C, which illustrate perspective views of the binding interface 110 mounting to the ride mode interface 100. In particular, FIG. 12A illustrates the first attachment toe pin 117 of the binding interface 110 engaging the pin attachment 103 of the toe receiving mechanism 101. Thereafter the, binding interface 110 can rotate about the first attachment toe pin 117.

For example, as shown in FIG. 12B, the binding interface 110 can rotate downward until the heel side base portion 115 abuts the heel receiving mechanism 102. In particular, the heel side base portion 115 of binding interface 110 can rest between the flanges 107 of the heel receiving mechanism 102. In a further implementation, the second attachment retractable pin 112 can be retracted into the heel portion 115 to allow the heel side base portion 115 to fully seat into heel receiving mechanism 102.

FIG. 12C illustrates a detailed view of the binding interface 110 mounted to ride mode interface 100. As shown, the heel side base portion 115 is fully seated into heel receiving mechanism 102, the second attachment retractable pin 112 may be allowed to extend out of the heel side base portion 115 and engage the pin attachment 105 of heel receiving mechanism 102, thereby securing the binding interface 110 to the ride mode interface 100.

Figure 13A:
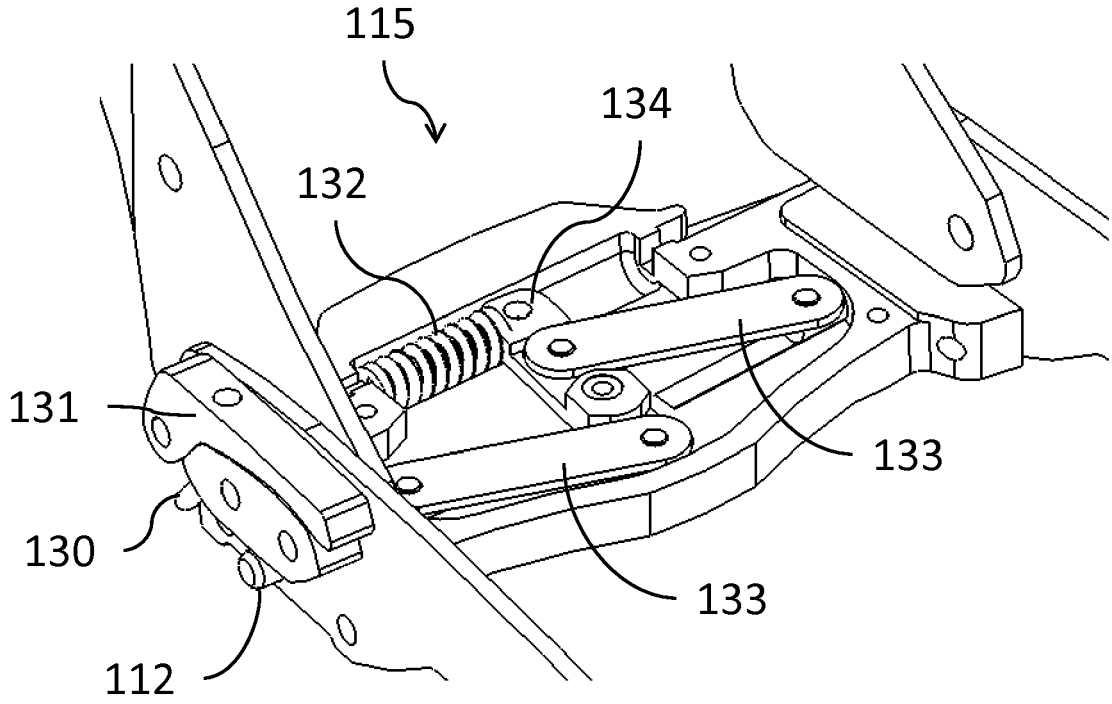
FIGS. 13A-13B are detailed views of an example embodiment of the heel side base portion and second attachment retractable pin of the binding interface of FIGS. 11A-11C.
Figure 13B:
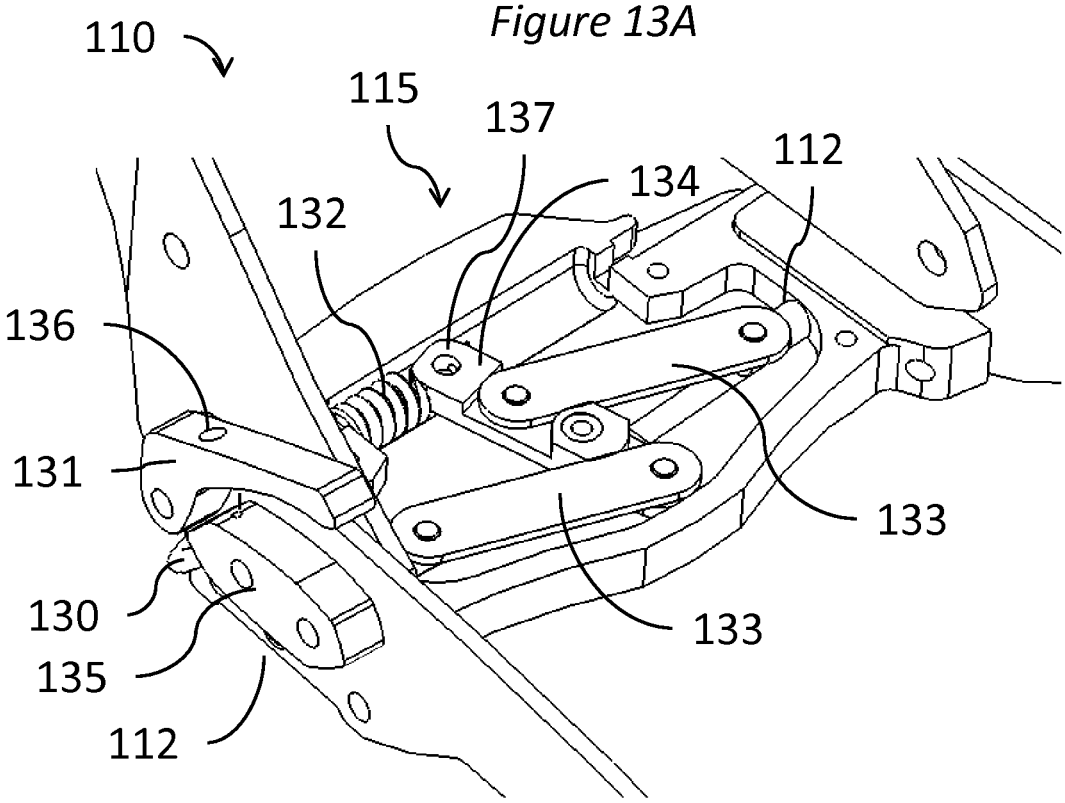

Reference is now made to FIGS. 13A-13B, which illustrate a detailed view of an example of the heel side base portion 115 and second attachment retractable pin 112 of binding interface 110. FIG. 13A shows second attachment retractable pin 112 extending from heel side base portion 115. In one implementation heel side base portion 115 is further comprised of a spring 132 pushing on first linkage 134 which is pivotally connected to second linkages 133 which are pivotally connected to at least one second attachment retractable pin 112. Second attachment retractable pin 112 can be extended from the heel side base portion 115 by the spring 132 pushing on the first linkage 134 and the first linkage 134 driving the second linkage 133 to extend the second attachment retractable pin 112 from heel side base portion 115.

FIG. 13B shows the second attachment retractable pin 112 retracted into the heel side base portion 115. In another implementation binding interface 110 can include a lever 131, a cable housing 130 with an internally routed cable, and a cable housing stop 135. One side of the internally routed cable of the cable housing 130 can be attached to the cable attachment 136 on the lever 131. The other side of the internally routed cable of the cable housing 130 can be attached to cable attachment 137 of first linkage 134. In one example, the second attachment retractable pin 112 can be retracted into the heel side base portion 115 by lifting the lever 131 which pulls on the internally routed cable of cable housing 130 further pulling on linkage 134 compressing spring 132 and pulling on second linkages 133 which retract second attachment retractable pin 112 into heel side base portion 115.

The binding apparatuses and components thereof disclosed herein and described in more detail above may be manufactured using any of a variety of materials and combinations thereof. In one implementation, a manufacturer may use one or more metals, such as Aluminum, Stainless Steel, Steel, Brass, alloys thereof, other similar metals, and/or combinations thereof to manufacture one or more of the components of the splitboard binding apparatus of the present disclosure. In further implementations, the manufacturer may use one or more plastics to manufacture one or more components of the splitboard binding apparatus of the present disclosure. In a yet further embodiment, the manufacturer may use carbon-reinforced materials, such as carbon-reinforced plastics, to manufacture one or more components of the splitboard binding apparatus of the present disclosure. In additional implementations, the manufacturer may manufacture different components using different materials to achieve desired material characteristics for the different components and the splitboard binding apparatus as a whole.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A binding apparatus for use on a splitboard to convert the splitboard between a ride mode and a tour mode, the binding apparatus comprising:

a binding interface configured to receive a boot, the binding interface comprising a first discrete attachment portion and a second discrete attachment portion generally opposing the first discrete attachment portion;

a ride mode interface configured to removably attach to the binding interface in a ride mode configuration; and a tour mode interface configured to removably attach to the binding interface in a tour mode configuration;

wherein the binding interface is configured to removably attach to the ride mode interface and the tour mode interface;

wherein the first discrete attachment portion of the binding interface is configured to engage the ride mode interface to secure the first discrete attachment portion of the binding interface to the ride mode interface without removing the first discrete attachment portion from the binding interface;

wherein the second discrete attachment portion of the binding interface is configured to releasably couple the second discrete attachment portion of the binding interface to the ride mode interface without removing the second discrete attachment portion from the binding interface;

wherein when the first discrete attachment portion and the second discrete attachment portion of the binding interface are coupled to the ride mode interface, the binding interface is caused to be substantially fixed to the ride mode interface during normal operation of the splitboard;

wherein the removable binding interface when attached to the ride mode interface securely joins splitboard halves to form a snowboard.

2. The binding apparatus of claim 1, wherein the binding interface further comprises a toe side portion and a heel side portion and wherein the first discrete attachment portion is either part of the toe side portion or the heel side portion and the second discrete attachment portion is part of the side portion opposing the first discrete attachment portion.

3. The binding apparatus of claim 2, wherein the ride mode interface comprises at least one toe receiving mechanism mounted to a first or second ski and at least one heel receiving mechanism mounted to the other of the first and second skis, and wherein the toe receiving mechanism is configured to receive the first discrete attachment portion of the binding interface and the heel receiving mechanism is configured to receive the second discrete attachment portion of the binding interface.

4. The binding apparatus of claim 3, wherein the first discrete attachment portion of the binding interface comprises a fixed pin and the second discrete attachment portion of the binding interface comprises a retractable pin.

5. The binding apparatus of claim 4, wherein the at least one toe receiving mechanism of the ride mode interface comprises a hook or tab configured to engage the fixed pin and the at least one heel receiving mechanism of the ride mode interface comprises an aperture to receive the retractable pin.

6. The binding apparatus of claim 2 wherein the first discrete attachment portion is configured to engage at least one hook and the second discrete attachment portion comprises a locking mechanism.

7. The binding apparatus of claim 6, wherein the ride mode interface comprises at least two separate components.

8. The binding apparatus of claim 6, wherein the ride mode interface comprises a first ride mode portion and a second ride mode portion, the first ride mode portion configured to attach to a first splitboard halve and the second ride mode portion configured to attach to a second splitboard halve.

9. The binding apparatus of claim 6, wherein the first discrete attachment portion, during engagement with the at least one hook, is configured to be pushed and/or pulled onto the at least one hook in a direction generally parallel to at least one constraining direction of the at least one hook.

10. The binding apparatus of claim 1, wherein the first discrete attachment portion is on either a first side or second side of the binding interface and the second discrete attachment portion is on the opposite side of the binding interface, wherein the first discrete attachment portion is configured to engage a hook and the second discrete attachment portion comprises a locking mechanism.

11. The binding apparatus of claim 1, further comprising at least one board joining device comprising at least one buckle element to mount to a first ski and at least one hook element to mount to a second ski, the buckle element having a shear tab to engage the second ski and the hook element having a shear tab to engage the first ski, wherein the shear tabs are configured to prevent shear movement of the first and second skis when joined together.

12. The binding apparatus of claim 1, wherein the first discrete attachment portion of the binding interface comprises a front portion of the binding interface and the second discrete attachment portion of the binding interface comprises a rear portion of the binding interface.

13. The binding apparatus of claim 1, wherein the binding interface comprises at least three attachments to the ride mode interface.

14. The binding apparatus of claim 1, wherein the first discrete attachment portion engages the ride mode interface such that the binding interface is constrained at least in a generally vertical direction and in a direction toward a center portion of the ride mode interface, and wherein the binding interface is configured to move away from a center portion of the ride mode interface when the second discrete attachment portion is disengaged to remove the binding interface from the ride mode interface.

15. The binding apparatus of claim 14, wherein the first discrete attachment portion of the binding interface comprises a front portion of the binding interface and the second discrete attachment portion of the binding interface comprises a rear portion of the binding interface.

16. The binding apparatus of claim 14, wherein the center portion of the ride mode interface is generally located at or near the seam of the splitboard.

17. The binding apparatus of claim 16, wherein the first discrete attachment portion is configured to engage at least one hook and the second discrete attachment portion comprises a locking mechanism.

18. The binding apparatus of claim 17, wherein the ride mode interface comprises at least two separate components.

19. The binding apparatus of claim 17, wherein the first discrete attachment portion, during engagement with the at least one hook, is configured to be pushed and/or pulled onto the at least one hook in a direction generally parallel to at least one constraining direction of the at least one hook.

20. The binding apparatus of claim 14, wherein the first discrete attachment portion is configured to engage at least one hook and the second discrete attachment portion comprises a locking mechanism.

21. The binding apparatus of claim 20, wherein the ride mode interface comprises at least two separate components.

22. The binding apparatus of claim 20, wherein the first discrete attachment portion, during engagement with the at least one hook, is configured to be pushed and/or pulled onto the at least one hook in a direction generally parallel to at least one constraining direction of the at least one hook.

23. The binding apparatus of claim 1, wherein the binding interface and the ride mode interface define a first configuration when the binding interface and the ride mode interface are coupled to each other, wherein the first configuration comprises:

a first attachment component of the binding interface configured to engage a toe receiving mechanism of the ride mode interface; and a second attachment component of the binding interface configured to engage a heel receiving mechanism of the ride mode interface;

wherein at least one of the first attachment component and the second attachment component of the binding interface is configured to selectively couple the binding interface to the ride mode interface and the same at least one of the first attachment component and the second attachment component of the binding interface is configured to selectively couple the binding interface to the tour mode interface.

24. The binding apparatus of claim 1, wherein the first discrete attachment portion is configured to engage at least one hook and the second discrete attachment portion comprises a locking mechanism.

25. The binding apparatus of claim 24, wherein the first discrete attachment portion comprises a pin.

26. The binding apparatus of claim 24, wherein an engagement side of the at least one hook faces away from a center portion of the ride mode interface.

27. The binding apparatus of claim 24, wherein the first discrete attachment portion, during engagement with the at least one hook, is configured to be pushed and/or pulled onto the at least one hook in a direction generally parallel to at least one constraining direction of the at least one hook.

28. The binding apparatus of claim 1, wherein the ride mode interface comprises at least two separate components.

29. The binding apparatus of claim 1, wherein the ride mode interface comprises a first ride mode portion and a second ride mode portion, the first ride mode portion configured to attach to a first splitboard halve and the second ride mode portion configured to attach to a second splitboard halve.

30. The binding apparatus of claim 29, wherein the first ride mode portion comprises a front portion of the ride mode interface and the second ride mode portion comprises a rear portion of the ride mode interface.

31. The binding apparatus of claim 1, wherein the first discrete attachment portion of the binding interface comprises only a front portion of the binding interface and the second discrete attachment portion of the binding interface comprises a rear portion of the binding interface.

32. A binding apparatus for use on a splitboard to convert the splitboard between a ride mode and a tour mode, the binding apparatus comprising:

a binding interface configured to receive a boot, the binding interface comprising a first discrete attachment portion and a second discrete attachment portion generally opposing the first discrete attachment portion;

a ride mode interface configured to removably attach to the binding interface in a ride mode configuration; and a tour mode interface configured to removably attach to the binding interface in a tour mode configuration;

wherein the binding interface is configured to removably attach to the ride mode interface and the tour mode interface;

wherein the first discrete attachment portion of the binding interface is configured to engage the ride mode interface to secure the first discrete attachment portion of the binding interface to the ride mode interface;

wherein the second discrete attachment portion of the binding interface is configured to releasably couple the second discrete attachment portion of the binding interface to the ride mode interface without removing the second discrete attachment portion from the binding interface;

wherein when the second discrete attachment portion of the binding interface is coupled to the ride mode interface the binding interface is configured to be substantially fixed to the ride mode interface during normal operation of the splitboard;

wherein the removable binding interface when attached to the ride mode interface securely joins splitboard halves to form a snowboard;

wherein the binding interface further comprises a toe side portion and a heel side portion and wherein the first discrete attachment portion is either part of the toe side portion or the heel side portion and the second discrete attachment portion is part of the side portion opposing the first discrete attachment portion;

wherein the ride mode interface comprises at least one toe receiving mechanism mounted to a first or second ski and at least one heel receiving mechanism mounted to the other of the first and second skis, and wherein the toe receiving mechanism is configured to receive the first discrete attachment portion of the binding interface and the heel receiving mechanism is configured to receive the second discrete attachment portion of the binding interface;

wherein the first discrete attachment portion of the binding interface comprises a fixed pin and the second discrete attachment portion of the binding interface comprises a retractable pin.

33. The binding apparatus of claim 32, wherein the at least one toe receiving mechanism of the ride mode interface comprises a hook or tab configured to engage the fixed pin and the at least one heel receiving mechanism of the ride mode interface comprises an aperture to receive the retractable pin.

* * * * *